US006786125B2

(12) United States Patent
Imai

(10) Patent No.: US 6,786,125 B2
(45) Date of Patent: Sep. 7, 2004

(54) CUTTER DEVICE FOR A PRINTER

(75) Inventor: Saburou Imai, Chiba (JP)

(73) Assignee: SII P & S Inc., Chiba (JP)

( * ) Notice: Subject to any disclaimer, the term of this patent is extended or adjusted under 35 U.S.C. 154(b) by 0 days.

(21) Appl. No.: 10/245,407

(22) Filed: Sep. 17, 2002

(65) Prior Publication Data

US 2003/0076396 A1 Apr. 24, 2003

(51) Int. Cl.[7] ..... B26D 5/08; B26D 1/08

(52) U.S. Cl. ..... 83/624; 83/628; 83/629; 83/636; 83/697; 83/694; 74/437; 192/48.92; 400/621

(58) Field of Search ..... 83/614, 624, 629, 83/627, 636, 697, 563, 566, 628, 694, 856, 635, 202, 214; 74/437, 435; 192/31, 44, 48.92; 400/621, 421

(56) References Cited

U.S. PATENT DOCUMENTS

| | | | | | |
|---|---|---|---|---|---|
| 97,140 | A | * | 11/1869 | Waker | 83/624 |
| 3,691,890 | A | * | 9/1972 | Kuchyt | 83/624 |
| 3,855,891 | A | * | 12/1974 | Young | 83/582 |
| 4,372,202 | A | * | 2/1983 | Cameron | 100/342 |
| 4,515,053 | A | * | 5/1985 | DuBois | 83/488 |
| 4,544,293 | A | | 10/1985 | Cranston et al. | 400/320 |
| 5,235,887 | A | * | 8/1993 | Moriya | 83/282 |
| 5,437,512 | A | | 8/1995 | Gull | 400/621 |
| 5,482,389 | A | | 1/1996 | Bickoff et al. | 400/621 |
| 5,749,277 | A | * | 5/1998 | Walker | 83/563 |
| 5,971,640 | A | * | 10/1999 | Brewington et al. | 400/621 |
| 5,974,930 | A | * | 11/1999 | Longrod | 83/629 |
| 6,109,154 | A | * | 8/2000 | Miyatsu et al. | 83/627 |
| 6,148,708 | A | * | 11/2000 | Pfeiffer | 83/628 |
| 6,152,007 | A | * | 11/2000 | Sato | 83/582 |
| 6,182,550 | B1 | * | 2/2001 | Brewington et al. | 83/603 |
| 6,405,625 | B1 | * | 6/2002 | Nomura et al. | 83/618 |

FOREIGN PATENT DOCUMENTS

| | | |
|---|---|---|
| DE | 3202264 | 8/1983 |
| EP | 0516118 | 12/1992 |

* cited by examiner

*Primary Examiner*—Boyer D. Ashley
(74) *Attorney, Agent, or Firm*—Adams & Wilks

(57) ABSTRACT

A cutter device has a movable blade, a stationary blade, and a clutch mechanism having a driven gear mounted for undergoing rotation in clockwise and counterclockwise directions and a driving gear for rotationally driving the driven gear about a rotational axis. A cutter drive mechanism has a rotation device connected to the clutch mechanism so that through one complete rotation of the driven gear the rotation device reciprocally moves the movable blade between a first region in which the movable blade is spaced apart from the stationary blade and a second region in which the movable blade cooperates with the stationary blade to cut recording paper. A rotation regulating device regulates rotation of the driven gear in the counterclockwise direction when the movable blade is in the first position.

15 Claims, 9 Drawing Sheets

CUTTER DEVICE FOR A PRINTER

BACKGROUND OF THE INVENTION

1. Field of the Invention

The present invention relates to a cutter device for a printer for cutting paper after printing.

2. Description of the Related Art

Thermal printers have been widely used as output devices for facsimile machines, POS systems and the like. In many cases, a roll of heat-sensitive paper is used as the recording paper.

Some of these printers use a roll of paper and are equipped with a cutter device for automatically cutting the recording paper after printing into an appropriate length.

The cutter device is equipped with a stationary blade and a movable blade, and the movable blade is driven with a predetermined timing using a dedicated drive source or a printer drive source to cut the recording paper after printing.

The movable blade is of two types: a type in which a round blade rolls along the stationary blade in a direction perpendicular to the recording paper conveying direction; and a so-called guillotine-type in which a plate-like blade with a clearance angle at the end moves toward and away from the stationary blade.

FIG. 6 shows an example of the guillotine type cutter device. FIG. 6 is an exploded perspective view showing an example of the construction of a conventional guillotine type cutter device C2.

As shown in FIG. 6, there are provided five gears arranged on an upper plate 136 of a head support plate 116: a gear (driving gear) 127, and driven gears 128, 129, 130, and 131, and axles 127*a*, 128*a*, 129*a*, 130*a*, and 131*a* for rotatably mounting these gears to the upper plate 136. These gears 127, 128, 129, 130, and 131 are arranged two-dimensionally along the upper plate 136 arranged parallel to the paper feeding direction X. Reference numeral 113 indicates a platen roller for conveying the recording paper (not shown) in the X-direction.

In a cutter drive mechanism 120, power transmitted through a bevel gear 126 is transmitted successively by way of the gear (driving gear) 127 and the driven gears 128, 129, 130, 131. The construction of the cutter drive mechanism 120 is such that the gears 128 and 1431 move in synchronism with a gear ration of one-to-one. At positions off the rotation centers of the gears 128 and 131, drive pins 128*b* and 131*b* protrude downwardly for driving the movable blade 112, causing a slide plate 117 to slide in the paper feeding direction X. The slide plate 117 has two guide grooves 117*a* and 117*b* in the form of elongated round holes extending in the direction perpendicular to the paper feeding direction X. At the time of assembly, the drive pins 128*b* and 131*b* are inserted into the guide grooves 117*a* and 117*b* under the upper plate 136 fixed to the upper surface of the support plate 136 fixed to the upper surface of the support plate 116 (on the thermal head side) so as to allow movement (sliding) in the paper feeding direction X with the cutter drive mechanism 120 therebetween. Thus, when the gears 127 through 131 rotate, the drive pins 128*b* and 131*b* rotate, and, with this rotation, the slide plate 117 reciprocates in a direction parallel to the paper feeding direction X. As a result the movable blade 112 fixed to the slide plate 117 reciprocates between the home position H and the cutting position C. In FIG. 7, the movable blade 112 is at the home position H, and in FIG. 8, it is at the cutting position C.

FIG. 9 shows the construction of the cutter drive mechanism 120.

As shown in FIG. 9, on the gear 128 of the cutter drive mechanism 120, there is formed a clutch portion 141 with a part of its teeth cut away; further, due to an engagement pin 145 provided at a position off the rotation center, the gear 128 is pressurized by a torsion spring 139 in a predetermined direction, which, in this example, is counterclockwise as seen from above the cutter drive mechanism 120.

The gear (driven gear) 128 and the gear (driving gear) 127 form a one-revolution (single-revolution) clutch mechanism 140. In the condition in which the clutch portion 141 is in contact with the gear 127, the gear 128 is pressurized counterclockwise by a force F2, so that, if the gear 127 rotates counterclockwise, there is no gear meshing, and no power is transmitted.

When the gear 127 rotates clockwise, it is engaged with the gear 128, and power is transmitted. And when the gear 127 rotates clockwise and the gear 128 makes one revolution, the movable blade 112 makes one reciprocation between the home position H and the cutting position C. Thereafter, when the gear 127 rotates counterclockwise, the clutch 141 is restored, while in contact with the gear 127, to the angle at which it is pressurized by the spring 139.

Thus, the angle of the gear 128 when printing is being performed through counterclockwise rotation of the gear 127 is always kept at a fixed level, and, during printing, the movable blade 112 is set at the home position H without fail.

By using the one-revolution mechanism 140 thus constructed, it is possible to reliably maintain the movable blade 112 at the home position without using any optical sensor or limit switch, making it advantageously possible to provide a cutter device C2 of a simple construction and high positional accuracy.

In the one-revolution clutch mechanism 140 provided in the cutter drive mechanism 120 of the cutter device C2 shown in FIGS. 6 through 9, when the gear 127 rotates counterclockwise, it idles with its teeth flicking clockwise the edge portion of the cutout portion 141 of the gear 128, so that no power is transmitted to the gear 128, and the cutter device is placed in the printable state in which the movable blade 112 is kept on standby at the home position H. The torsion spring 139 which engages in this state with the engagement pin 145 of the gear 128 to impart an urging force in the direction F2 is relatively large, and its resilient force is strong, so that there is a great crackling noise when the gear 128 is flicked, which constitutes a noise factor in the printer operation.

Further, the vibration when the gear 128 is flicked is relatively great, and the vibration generated between the gear (driving gear) 127 and the gear (driven gear) 128 during printing may be transmitted to the entire printer through the other driven gears 129, 130, 131, etc., thereby adversely affecting the printing quality.

SUMMARY OF THE INVENTION

This invention has been made with a view to solving the above-mentioned problems in the prior art. It is an object of this invention to provide a cutter device for a printer in which in a printing state in which a movable blade is on standby for movement, it is possible to reduce a flicking noise generated between gears and to restrain vibrations generated thereby.

In order to achieve the above-mentioned object, according to the present invention, there is provided a cutter device for a printer equipped with a movable blade (17) and a stationary blade (300) for cutting at a predetermined position recording paper which has undergone printing by a printing means, the cutter device including:

a cutter drive mechanism (20) for causing the movable blade to advance and retreat with respect to the stationary blade, the cutter drive mechanism being equipped with a rotation mechanism which causes, through one rotation of a driven gear (28) connected to the movable blade, the movable blade to make one reciprocation between a home position (H) spaced apart from the stationary blade by a predetermined distance and a cutting position (c) where it cuts the recording paper through cooperation with the stationary blade, the rotation mechanism being connected to a one-way clutch mechanism (40) connected to a driving means capable of normal and reverse rotation and adapted to rotate a platen roller (13) in the paper feeding direction when the driving means makes normal rotation and to drive the movable blade of the cutter when the driving means makes reverse rotation, the one-way clutch mechanism being composed of a driving gear (27) connected to the driving means and a driven gear (28) in mesh with the driving gear, the driven gear having in a part of its outer peripheral portion (101) where teeth (G2) are formed a cutout portion (102) corresponding to a predetermined number of teeth, the tooth surface of a trigger gear member (T) that is equipped with teeth (G3) in a number less than that corresponding to the cutout portion facing the cutout portion with arranging an arm portion (A) supporting the tooth surface while urging it clockwise, urging means (torsion spring S) for imparting a clockwise urging force and being arranged on the arm portion of the trigger gear member.

the driven gear being equipped with a rotation regulating means (K) for regulating counterclockwise rotation of the driven gear itself with the movable blade being at rest at the home position, the driving gear being also engaged with the tooth surface of the trigger gear member to transmit driving force to the driven gear when it rotates counterclockwise and causing the teeth of the trigger gear member to retreat against the urging force so as to flick them counterclockwise when it rotates clockwise so as not to transmit driving force to the driven gear regulated in counterclockwise rotation by the rotation regulating means.

By the foregoing construction, the driven gear is equipped with members such as a relatively small trigger gear member and urging means, so that it is possible to reduce the size of the one-way clutch mechanism as compared with the prior art. Since the urging force of the trigger gear member is small, it is possible, during execution of printing and paper feeding, to reduce the noise made when the driving gear rotates clockwise to flick the teeth of the trigger gear member as compared with the prior art.

Further, since it is also possible to reduce the vibration when the driving gear rotates clockwise to flick the teeth of the trigger gear member, it is possible to avoid a situation in which vibration generated in the one-way clutch mechanism is transmitted to the components of the printer to adversely affect the printing quality.

Since it is accommodated inside a hollow portion formed in the inner periphery of the driven gear, it is possible to further reduce the size of the one-way clutch mechanism.

Further, it is possible for the arm portion of the trigger gear member to be rotatably supported at a position off the rotation axis of the driven gear, whereby it is possible to realize, with a simple construction, a counterclockwise retreating movement of the trigger gear member when the driving gear rotates clockwise.

Further, the arm portion of the trigger gear member is formed of a flexible material. When the driving gear rotates clockwise, the arm itself undergoes counterclockwise deformation, making it possible to cancel its engagement with the teeth of the driving gear. Thus, when the driving gear rotates clockwise, it is possible to aid the counterclockwise retreating movement of the trigger gear member, and to absorb the vibration when the driving gear rotates clockwise to flick the teeth of the trigger gear member, thereby restraining the vibration and reducing the noise generated.

Further, the rotation regulating means is composed of a protrusion formed on the bottom surface of the driven gear and having a vertical surface and an inclined surface, a vertical portion arranged in the vicinity of the rotation axis of the driven gear and adapted to engage with the vertical surface of the protrusion in the state in which the movable blade is at rest at the home position to regulate the counterclockwise rotation of the driven gear, and a rotation regulating member equipped with an arm portion adapted to be displaced along the inclined surface of the protrusion when the driven gear is rotated clockwise. Thus, it is possible, with a simple construction, to regulate the counterclockwise rotation of the driven gear itself in the state in which the movable blade is at rest at the home position.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENT

A preferred embodiment of the present invention will now be described with reference to the drawings.

Figure 1:
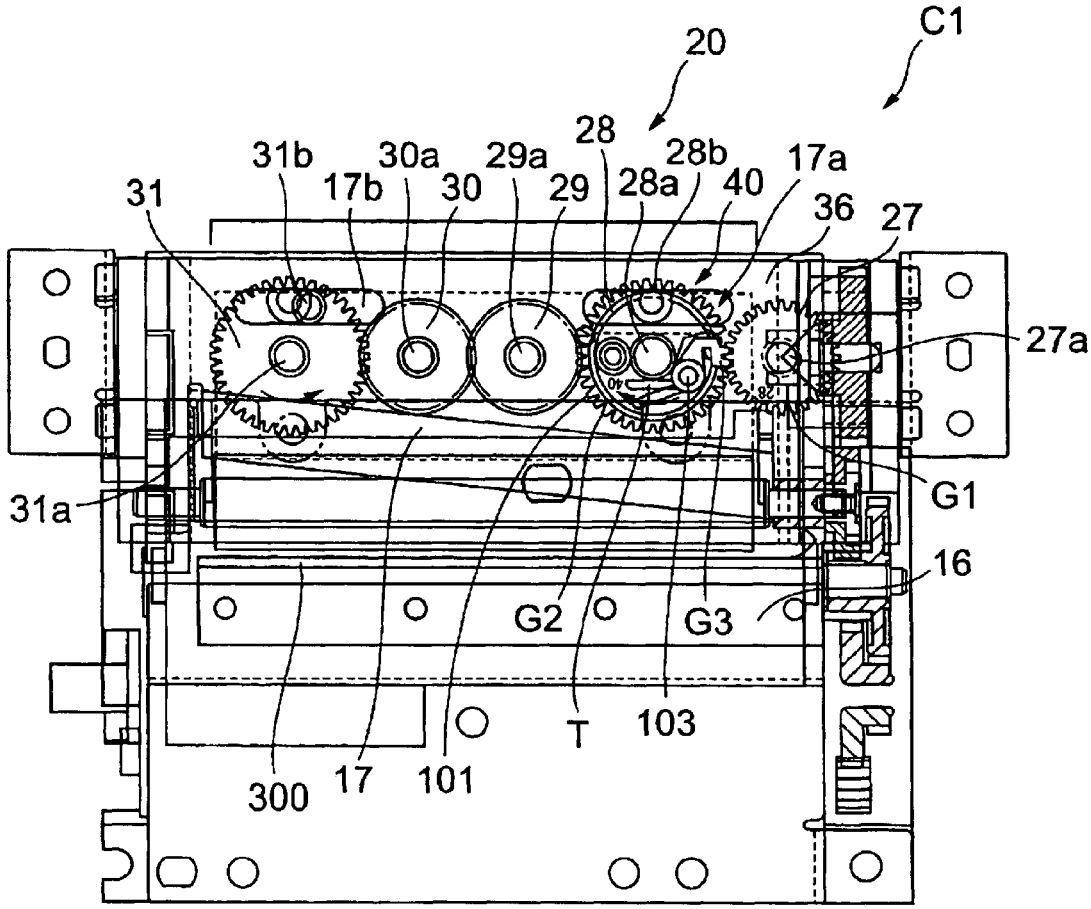
FIG. 1 is a plan view showing a construction of a cutter device for a printer according to this embodiment.
Figure 2:
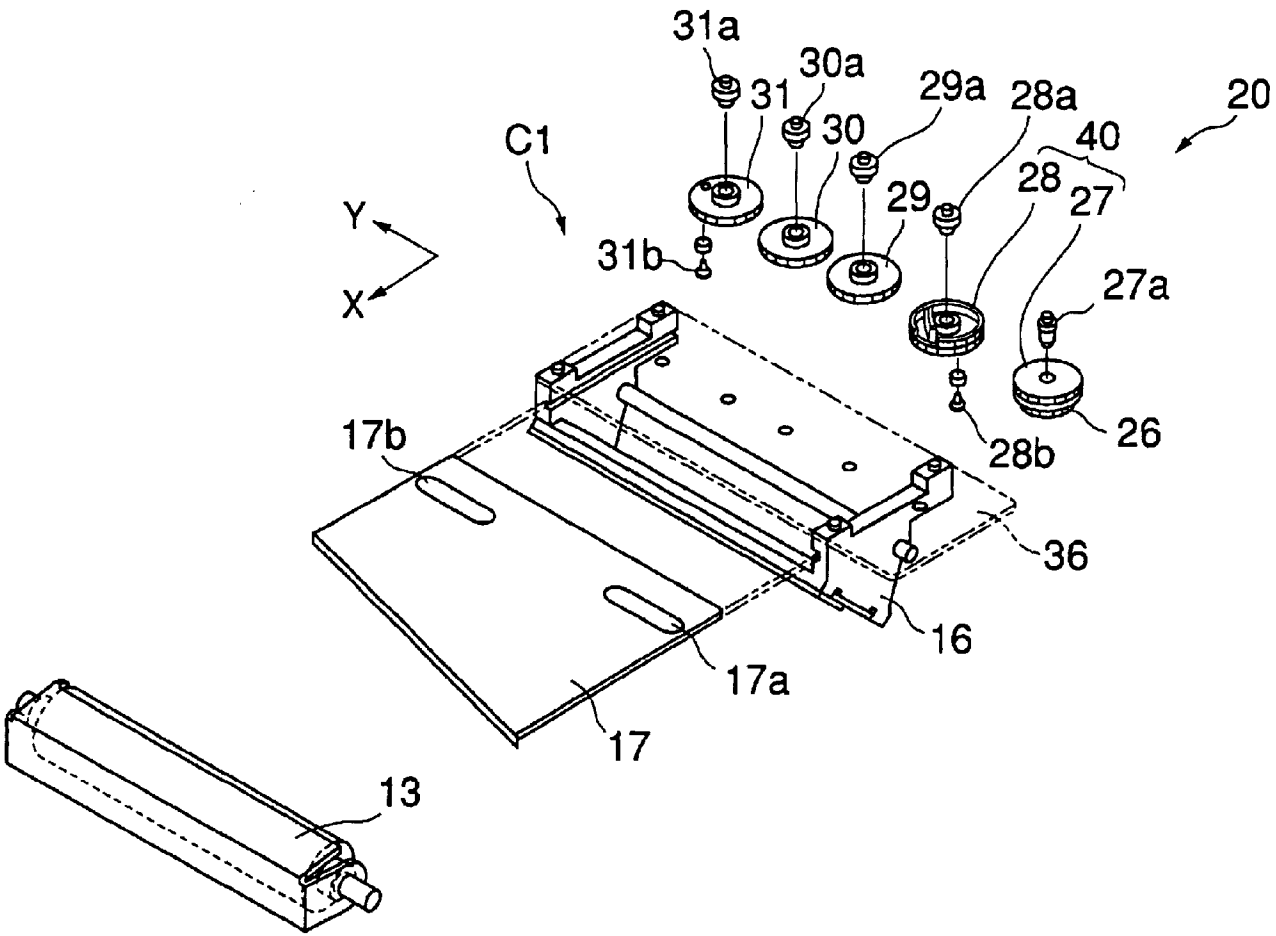
FIG. 2 is an exploded perspective view showing the construction of the cutter device for a printer according to this embodiment.
Figure 3A:
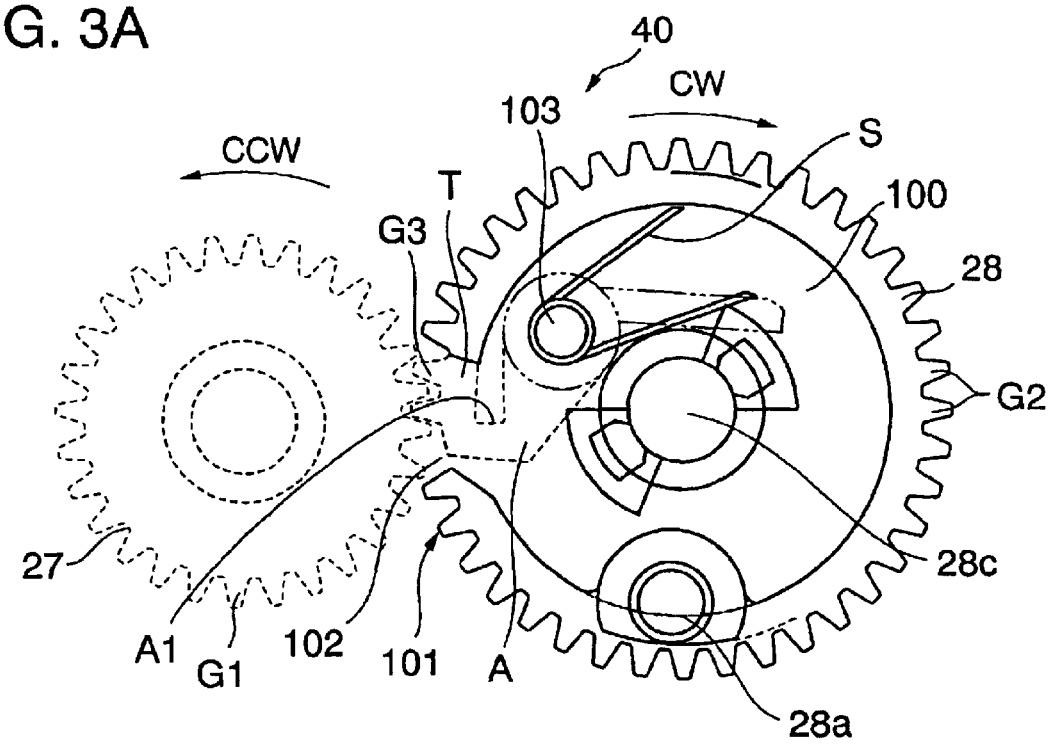
FIG. 3 is an explanatory drawing showing an operation of a one-way clutch mechanism constituting a main portion of the cutter device for a printer of this embodiment.
Figure 3B:
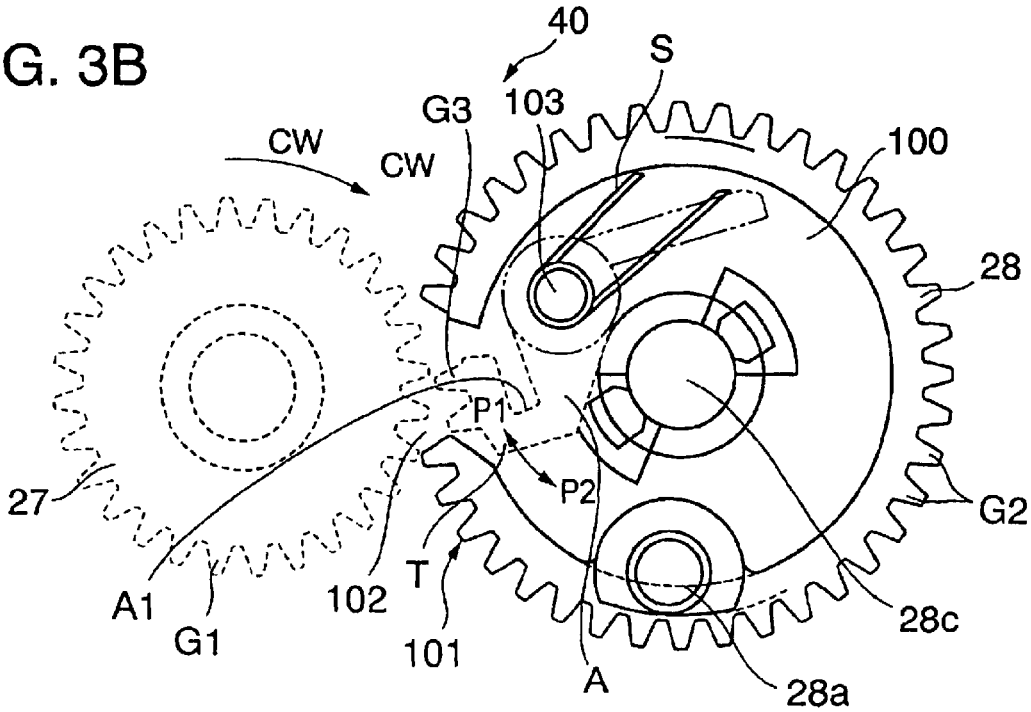
Figure 4:
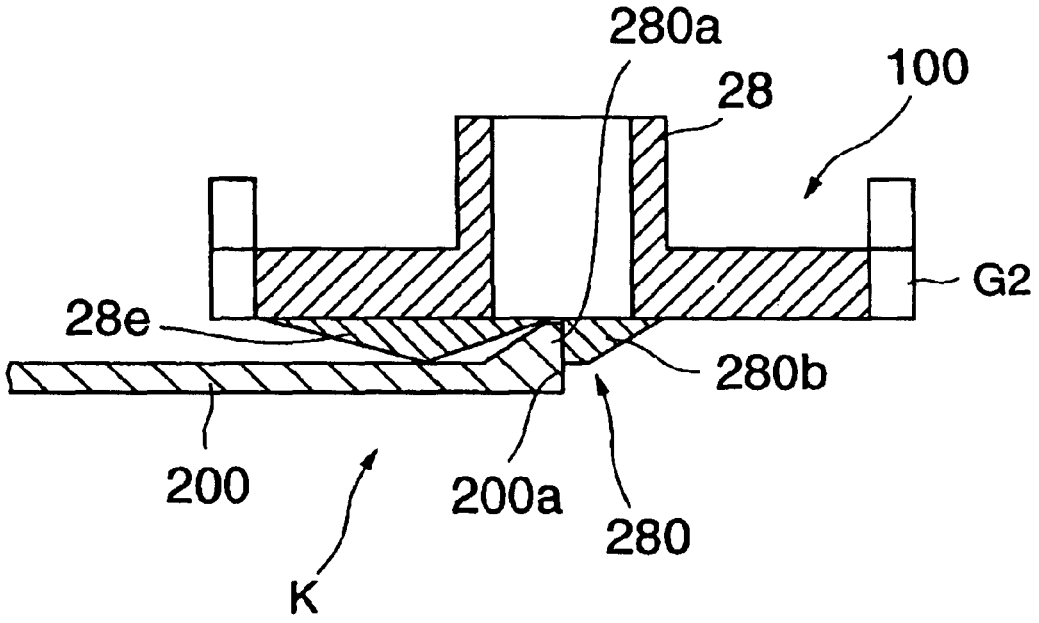
FIG. 4 is a sectional view showing a construction example of a driven-gear-rotation regulating means constituting a main portion of the cutter device for a printer of this embodiment.
Figure 5A:
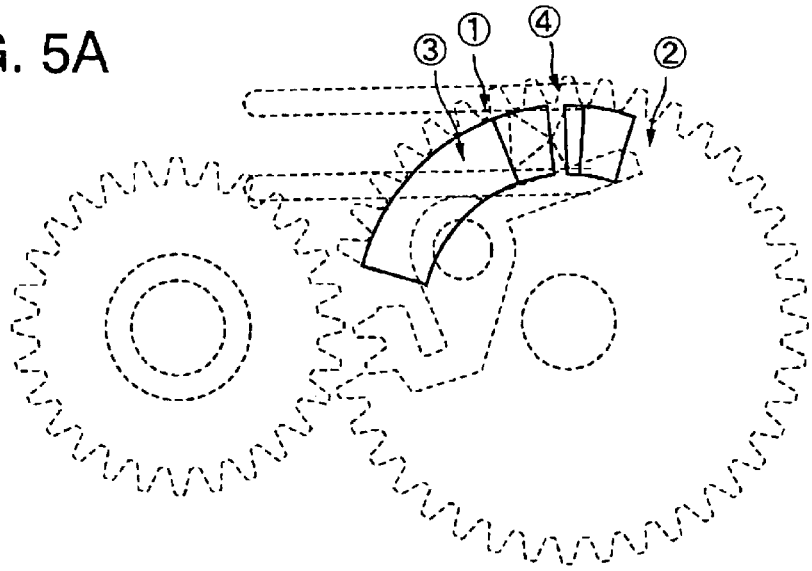
FIG. 5 is an explanatory drawing showing states of the rotation regulating means.
Figure 5B:
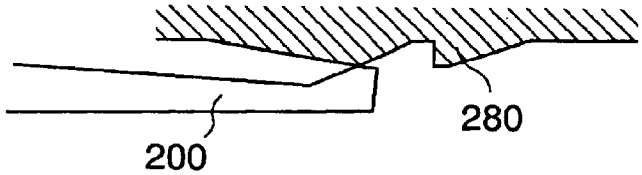
Figure 5C:
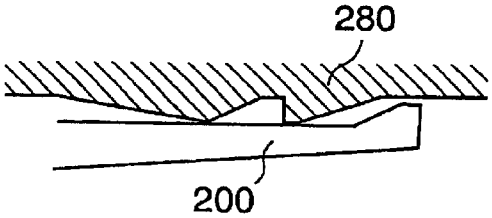
Figure 5D:
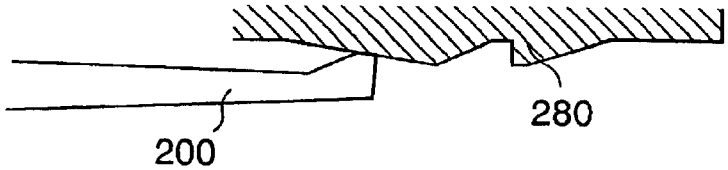
Figure 5E:
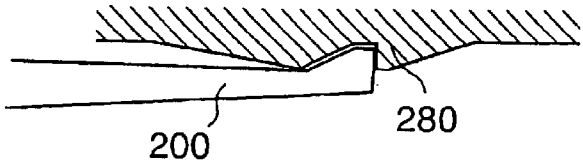
Figure 6:
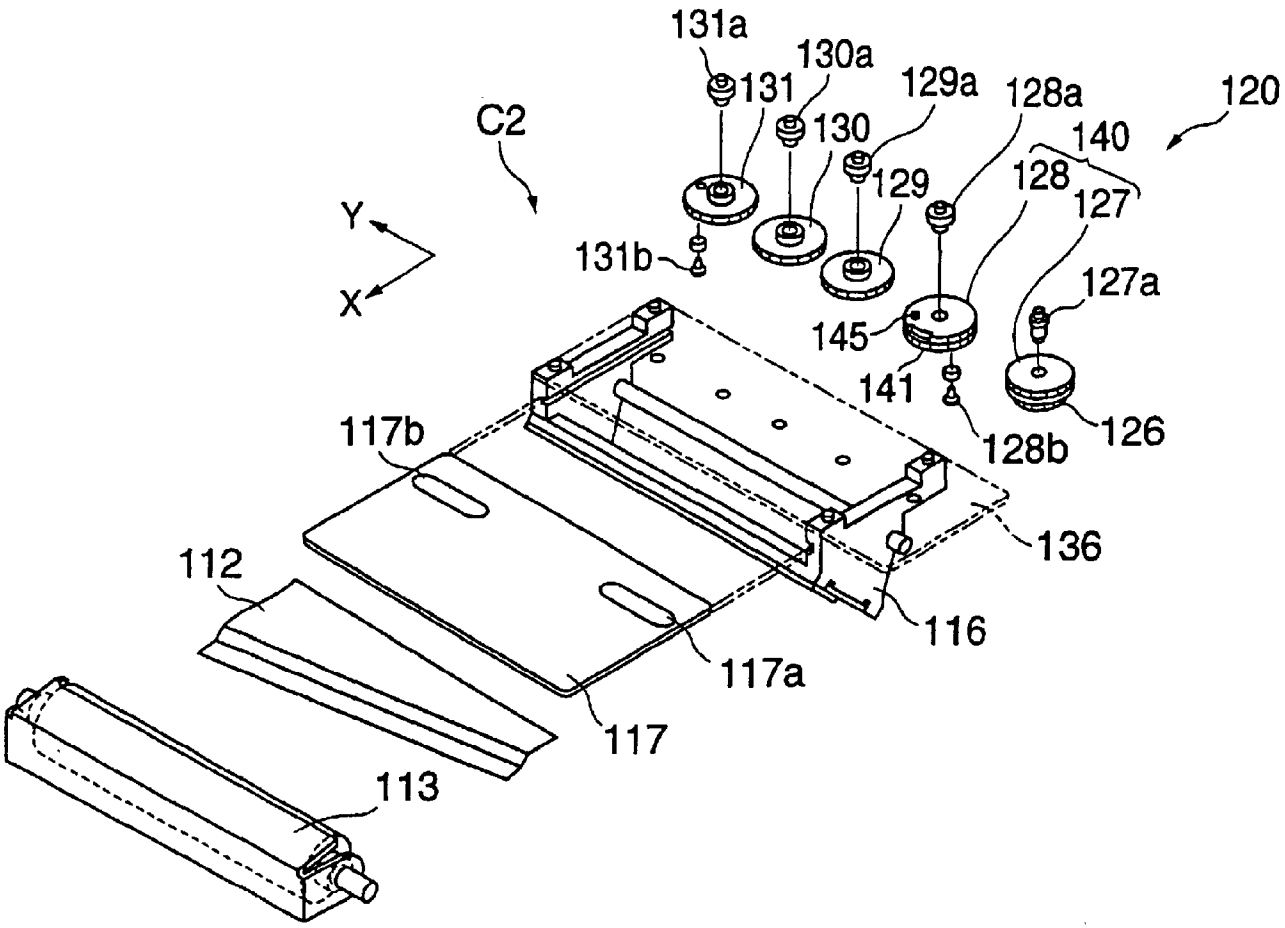
FIG.6 PRIOR ART
FIG. 6 is an exploded perspective view showing a construction of a conventional cutter device for a printer.

FIG. 1 is a plan view showing a construction of a cutter device for a printer according to this embodiment; FIG. 2 is an exploded perspective view thereof; FIG. 3 is an explanatory diagram illustrating the operation of a one-way clutch mechanism constituting a main portion of the cutter device; FIG. 4 is a sectional view showing a construction example of a driven-gear-rotation regulating means constituting a main portion of the cutter device; and FIG. 5 is an explanatory drawing showing the states of the rotation regulating means.

As shown in FIGS. 1 and 2, a cutter device C1 for a printer according to this embodiment is equipped with five gears: a gear (driving gear) 27 and driven gears 28, 29, 30, and 31 arranged on an upper plate 36 of a head support plate 16, and axles 27*a*, 28*a*, 29*a*, 30*a*, and 31*a* for rotatably mounting the gears to the upper plate 36.

These gears 27, 28, 29, 30, and 31 are arranged two-dimensionally along the upper plate 36 arranged parallel to the paper feeding direction X. In FIG. 2, reference numeral 13 indicates a platen roller for conveying recording paper (not shown) in the X-direction.

In the cutter drive mechanism 20 of the cutter device C1, power transmitted through a bevel gear 26 (See FIG. 2) is transmitted successively through the gear (driving gear) 27 and the driven gears 28, 29, 30, and 31. The cutter drive mechanism 20 is constructed with a gear arrangement such that the gears 28 and 31 move in synchronism at a gear ratio of one-to-one; at positions off the rotation centers of the gears 28 and 31, there protrude upwards drive pins 28*b* and 31*b* for causing a plate-like movable blade 17 to slide in the paper feeding direction X.

Figure 7:
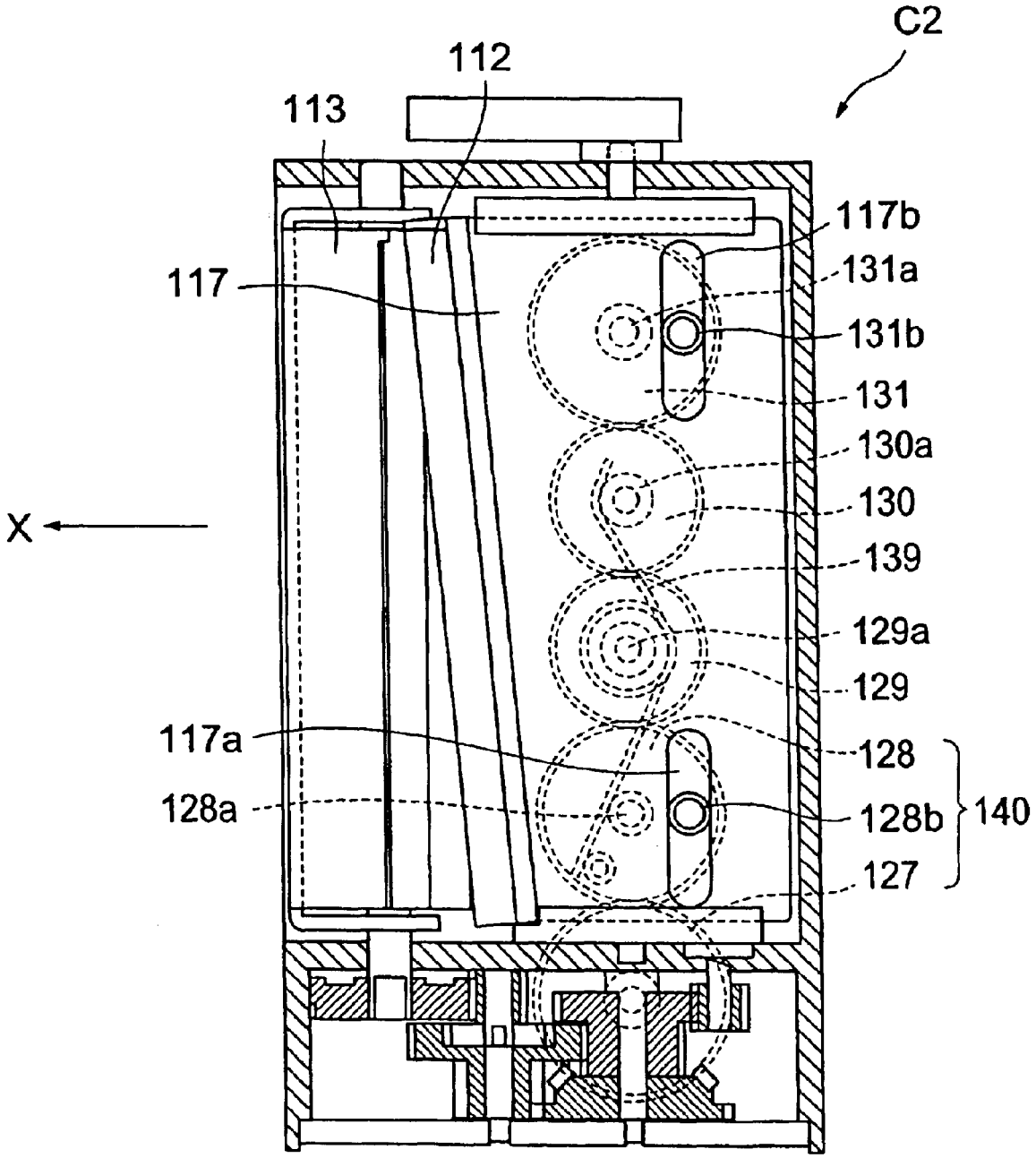
PRIOR ART FIG.7
FIG. 7 is an explanatory drawing showing a home position H of a movable blade of the cutter device for a printer.
Figure 8:
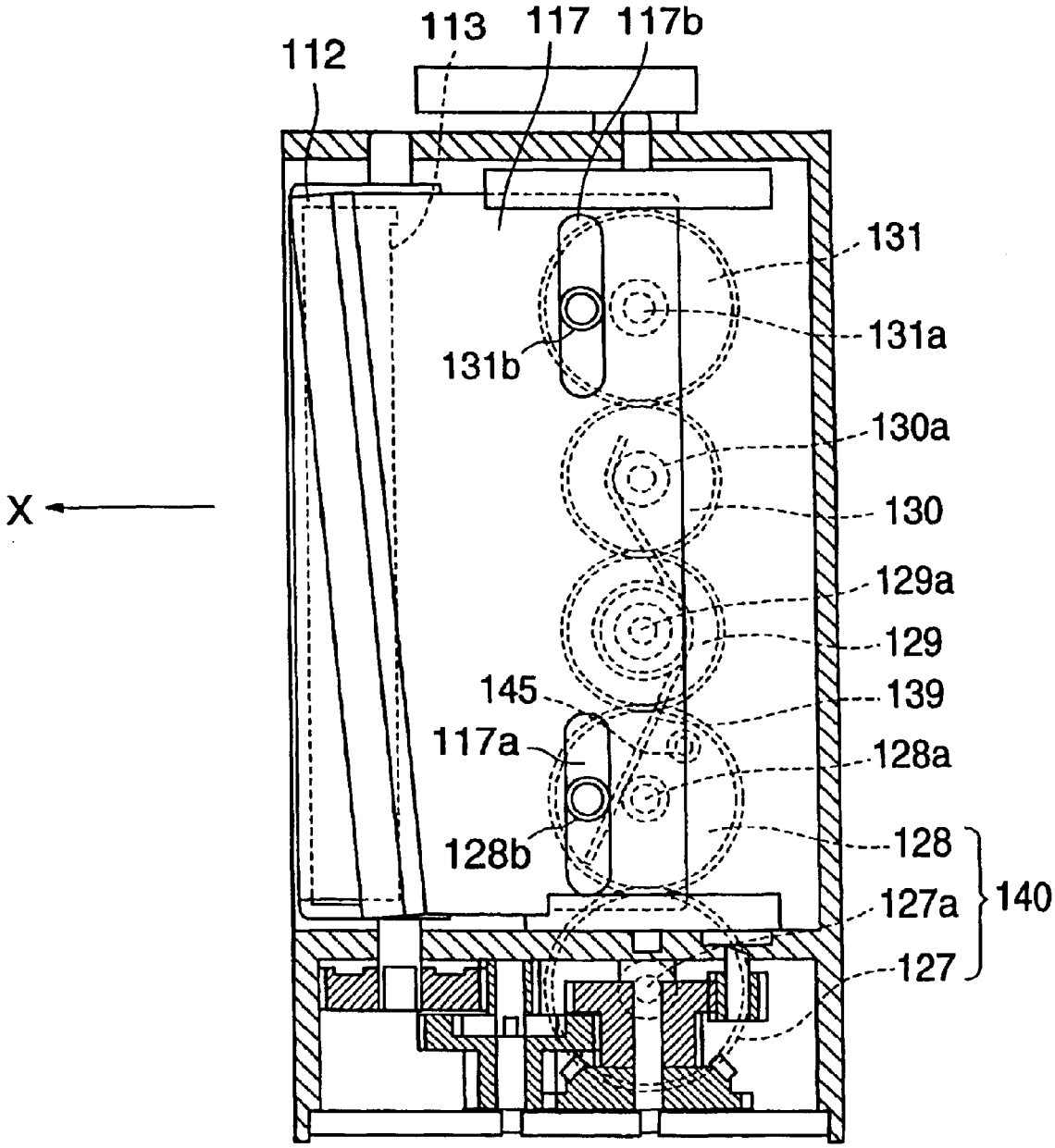
PRIOR ART FIG.8
FIG. 8 is an explanatory drawing showing a cutting position C of the movable blade of the cutter device for a printer.
Figure 9:
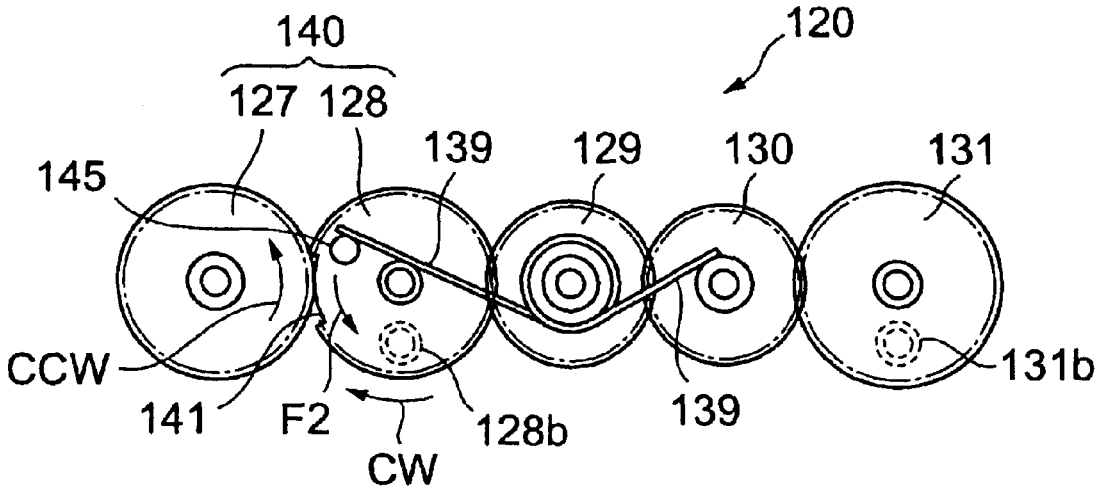
FIG.9 PRIOR ART
FIG. 9 is a plan view showing the construction of the cutter drive mechanism of a conventional cutter device for a printer.

Further, the movable blade 17 has two guide grooves 17*a* and 17*b* in the form of elongated round holes extending in the Y-direction, which is perpendicular to the paper feeding direction X. At the time of assembly, the drive pins 28*b* and 31*b* are inserted into these guide grooves 17*a* and 17*b* under the upper plate 36 fixed to the upper surface of the support plate 16 (on the thermal head side) so as to allow movement (sliding) in the paper feeding direction X with the cutter drive mechanism 20 placed therebetween. Thus, when the gears 27 through 31 rotate, the drive pins 28*b* and 31*b* rotate, and, with this rotation, the movable blade 17 reciprocates in a direction parallel to the paper feeding direction X. As a result, the movable blade 17 reciprocates between a home region or position H and a cutting region or position C (See FIGS. 7 and 8 for the positional relationship between the home position H and the cutting position C as described above).

It is noted that a stationary blade 300 is perpendicular to the direction in which the movable blade 17 advance and retreats and is arranged at a position where it can cooperate with the edge of the movable blade 17 to cut the recording paper (not shown).

As shown in FIG. 3, a one-way clutch mechanism 40 of the cutter drive mechanism 20 comprises a driving gear 27 and a driven gear 28.

The driven gear 28 has a hollow portion 100 in its inner periphery, and, in a portion of the outer peripheral portion 101 where a large number of teeth G2 are formed, a cutout portion 102 corresponding to a predetermined number of teeth and communicating with the hollow portion 100; a trigger gear member T having teeth G3 in a number less than the number of teeth corresponding to the cutout portion 102 (two in this embodiment) is arranged such that the surface of the teeth G3 faces the cutout portion 102; an arm portion A is accommodated in the hollow portion 100 so as to support the teeth G3 while urging them clockwise.

The arm portion of the trigger gear member T is rotatably supported by a rotation axis 103 arranged off the rotation axis 28*c* of the driven gear 28.

Further, the trigger gear member T is formed of flexible plastic or the like. At the forward end of the arm portion A of the trigger gear member T, a U-shaped bent portion A1 is formed so that counterclockwise force can easily escape. Due to this arrangement, it is possible to aid the counterclockwise retreating movement of the trigger gear member T when the driving gear 27 rotates clockwise. Further, it is possible to absorb the vibration when the driving gear 27 rotates clockwise to flick the teeth G3 of the trigger gear member T to thereby restrain the vibration and to reduce the noise generated.

Further, arranged inside the hollow portion 100 of the driven gear 28 is a torsion spring S fitted onto a rotation axis 103 and serving as an urging means for imparting a clockwise urging force to the arm portion A of the trigger gear member T.

Further, the driven gear 28 is provided with a rotation regulating means K for regulating counterclockwise rotation of the driven gear 28 itself in the state in which the movable blade 17 is at rest at the home position H.

As shown in FIG. 4, in this embodiment, the rotation regulating means K is composed of a protrusion 280 formed on the bottom surface of the driven gear 28 and having a vertical surface 280*a* and an inclined surface 280*b*, a vertical portion 200*a* arranged in the vicinity of the rotation axis 28*c* of the driven gear 28 on the upper plate 36 and adapted to engage with the vertical surface 280*a* of the protrusion 280 in the state in which the movable blade 17 is at rest at the home position H to regulate the counterclockwise rotation of the driven gear 28, and an arm-like rotation regulating member 200 adapted to be displaced along the inclined surface 280*b* of the protrusion 280 when the driven gear 28 is rotated clockwise.

The rotation regulating means K is constructed such that at the start of cutting operation (state (1) of FIG. 5(*a*)), just before the completion of cutting operation (state (2) of FIG. 5(*a*)) and at the time of completion of cutting operation (state (3) of FIG. 5(*a*)), the arm-like rotation regulating member 200 and the protrusion 280 of the driven gear 28 are in a non-engaged state, as shown in FIGS. 5(*b*) through 5(*d*), thus maintaining a state in which the driven gear 28 can rotate.

On the other hand, during printing (state (4) of FIG. 5(*a*)), the arm-like rotation regulating member 200 and the protrusion 280 of the driven gear 28 are in an engaged state as shown in FIG. 5(*e*), whereby rotation of the driven gear 28 is regulated.

Thus, it is possible to regulate, with a simple construction, counterclockwise rotation of the driven gear 28 itself in the state in which the movable blade 17 is at rest at the home position H (the printable state).

In the cutter device C1, constructed as described above, when the driving gear 27 rotates counterclockwise, it engages with, in addition to the teeth G2 in the outer peripheral portion of the driven gear 28, the teeth G3 of the trigger gear member T, as shown in FIG. 3(*a*), and transmits driving force to the driven gear 28 to cause the movable blade 17 to make one reciprocation between the home position H and the cutting position C; when the driving gear 27 rotates clockwise, the teeth G3 of the trigger gear member T are caused to retreat against the urging force so as to flick the teeth counterclockwise (swung between points P1 and P2 of FIG. 3(*b*)), as shown in FIG. 3(*b*) so that no driving force may be transmitted to the driven gear 28, which is regulated in counterclockwise rotation by the rotation regulating means K, whereby it is possible to perform printing on the recording paper.

Then, in accordance with this embodiment, the hollow portion 100 of the driven gear 28 contains members, such as the trigger gear member T and the torsion spring S serving as the urging means, so that it is possible to reduce the size of the one-way clutch mechanism 30 as compared with the prior art. Since the urging force of the trigger gear member T is small, it is possible to reduce the noise generated when the driving gear 27 rotates clockwise to flick the teeth G3 of the trigger gear member T during execution of a printing operation and during paper feeding as compared with the prior art.

Further, it is also possible to reduce the vibration generated when the driving gear 27 rotates clockwise to flick the teeth of the trigger gear member, so that it is possible to prevent the vibration generated in the one-way clutch mechanism 40 from being transmitted to the printer components to adversely affect the printing quality.

It is understood that regarding other devices, modifications are possible as appropriate without departing from the technical scope of the present invention.

For example, while in this embodiment the one-way clutch mechanism 40 is accommodated in the hollow portion 100 of the driven gear 28, this should not be construed restrictively. It may also be possible to arrange it on the front or back side of the driven gear.

A described above, in accordance with the present invention, the driven gear is equipped with members, such as a relatively small trigger gear member and an urging means, so that it is possible to reduce the size of the one-way clutch mechanism itself as compared with the prior art. Since the urging force of the trigger gear member is small, it is possible to reduce the noise generated when the driving gear rotates clockwise to flick the teeth of the trigger gear member during execution of a printing operation and during paper feeding as compared with the prior art.

Further, it is also possible to reduce the vibration when the driving gear rotates clockwise to flick the teeth of the trigger gear member, so that it is possible to prevent the vibration generated in the one-way clutch mechanism from being transmitted to the printer components to adversely affect the printing quality.

What is claimed is:

1. A cutter device for cutting recording paper, the cutter device comprising:

a movable blade;

a stationary blade;

a clutch mechanism having a driven gear mounted for undergoing rotation in clockwise and counterclockwise directions and a driving gear for rotationally driving the driven gear about a rotational axis;

a cutter drive mechanism having a rotation device connected to the clutch mechanism so that through one complete rotation of the driven gear the rotation device reciprocally moves the movable blade between a first region in which the movable blade is spaced apart from the stationary blade and a second region in which the movable blade cooperates with the stationary blade to cut recording paper; and rotation regulating means for regulating rotation of the driven gear in the counterclockwise direction when the movable blade is in the first region, the rotation regulating means comprising a protrusion formed on a surface of the driven gear and having a vertical surface and an inclined surface, a vertical portion disposed in the vicinity of the rotational axis of the driven gear for engagement with the vertical surface of the protrusion when the movable blade is in the first region to thereby regulate rotation of the driven gear in the counterclockwise direction, and a rotation regulating member having an arm portion for undergoing displacement along the inclined surface of the protrusion when the driven gear undergoes rotation in the clockwise direction.

2. A cutter device for cutting at a predetermined position recording paper which has undergone printing by a printer, the cutter device comprising:

a movable blade;

a stationary blade;

a one-way clutch mechanism having a driven gear and a driving gear for rotationally driving the driven gear, the driven gear having an outer peripheral portion, a plurality of teeth formed on a part of the outer peripheral portion, and a cutout portion formed on a part of the outer peripheral portion different from the part on which the teeth are formed;

a trigger gear member having a peripheral surface portion and an arm portion integrally connected to the peripheral surface portion, the peripheral surface portion having a preselected number of teeth for undergoing rotational movement in clockwise and counterclockwise directions within the cutout portion of the driven gear, the teeth of the trigger gear member being disposed in meshing engagement with the driving gear to transmit a rotational driving force to the driven gear in the clockwise direction;

biasing means for biasing the arm portion of the trigger member in the clockwise direction, the driving gear being disposed in meshing engagement with the teeth of the trigger member to displace the teeth of the trigger member in the counterclockwise direction against the bias of the biasing means during rotation of the driving gear in the clockwise direction so that the teeth of the trigger member do not transmit a rotational driving force to the driven gear in the counterclockwise direction;

a cutter drive mechanism having a rotation device connected to the one-way clutch mechanism so that through one rotation of the driven gear the rotation device reciprocally moves the movable blade between a home region in which the movable blade is spaced-apart from the stationary blade and a cutting region in which the movable blade cooperates with the stationary blade to cut a recording paper; and rotation regulating means for regulating rotation of the driven gear in the counterclockwise direction when the movable blade is in the home position.

3. A cutter device according to claim 1; wherein the rotation regulating means comprises a protrusion formed on a bottom surface of the driven gear and having a vertical surface and an inclined surface; a vertical portion disposed in the vicinity of a rotation axis of the driven gear for engagement with the vertical surface of the protrusion when the movable blade is in the home region to thereby regulate rotation of the driven gear in the counterclockwise direction; and a rotation regulating member having an arm portion for undergoing displacement along the inclined surface of the protrusion when the driven gear undergoes rotation in the clockwise direction.

4. A cutter device according to claim 1; wherein the biasing means comprises a torsion spring.

5. A cutter device according to claim 1; wherein the driven gear has a hollow portion; and wherein the trigger gear member is disposed in the hollow portion of the driven gear.

6. A cutter device according to claim 5; wherein the rotation regulating means comprises a protrusion formed on a bottom surface of the driven gear and having a vertical surface and an inclined surface; a vertical portion disposed in the vicinity of a rotation axis of the driven gear for engagement with the vertical surface of the protrusion when the movable blade is in the home region to thereby regulate rotation of the driven gear in the counterclockwise direction; and a rotation regulating member having an arm portion for undergoing displacement along the inclined surface of the protrusion when the driven gear undergoes rotation in the clockwise direction.

7. A cutter device according to claim 1; wherein the driven gear is supported for undergoing rotation about a first rotational axis; and wherein the arm portion of the trigger gear member is supported for undergoing rotation about a second rotational axis different from the first rotational axis.

8. A cutter device according to claim 7; wherein the rotation regulating means comprises a protrusion formed on a bottom surface of the driven gear and having a vertical surface and an inclined surface; a vertical portion disposed in the vicinity of the first rotational axis for engagement with the vertical surface of the protrusion when the movable blade is in the home region to thereby regulate rotation of the driven gear in the counterclockwise direction; and a rotation regulating member having an arm portion for undergoing displacement along the inclined surface of the protrusion when the driven gear undergoes rotation in the clockwise direction.

9. A cutter device according to claim 1; wherein the arm portion of the trigger gear member is formed of a flexible material so that when the driving gear undergoes rotation in the clockwise direction, the arm portion is deformed in the counterclockwise direction so that teeth of the trigger member gear are not in meshing engagement with the teeth of the driving gear.

10. A cutter device according to claim 9; wherein the rotation regulating means comprises a protrusion formed on a bottom surface of the driven gear and having a vertical surface and an inclined surface; a vertical portion disposed in the vicinity of a rotation axis of the driven gear for engagement with the vertical surface of the protrusion when the movable blade is in the home region to thereby regulate rotation of the driven gear in the counterclockwise direction; and a rotation regulating member having an arm portion for undergoing displacement along the inclined surface of the protrusion when the driven gear undergoes rotation in the clockwise direction.

11. A cutter device for cutting recording paper, the cutter device comprising:

a movable blade;

a stationary blade;

a clutch mechanism having a driven gear mounted for undergoing rotation in clockwise and counterclockwise directions and a driving gear for rotationally driving the driven gear about a rotational axis;

a cutter drive mechanism having a rotation device connected to the clutch mechanism so that through one complete rotation of the driven gear the rotation device reciprocally moves the movable blade between a first region in which the movable blade is spaced apart from the stationary blade and a second region in which the movable blade cooperates with the stationary blade to cut recording paper;

rotation regulating means for regulating rotation of the driven gear in the counterclockwise direction when the movable blade is in the first region; and a trigger gear member having a peripheral surface portion and an arm portion integrally connected to the peripheral surface portion, the peripheral surface portion having a preselected number of teeth for meshing engagement with the driving gear to transmit a rotational driving force to the driven gear.

12. A cutter device according to claim 11; wherein the driven gear has a hollow portion; and wherein the trigger gear member is disposed in the hollow portion of the driven gear.

13. A cutter device according to claim 11; wherein the arm portion of the trigger gear member is supported for undergoing rotation about a rotational axis different from the rotational axis of the driven gear.

14. A cutter device according to claim 11; further comprising biasing means for biasing the arm portion of the trigger gear member in the clockwise direction.

15. A cutter device according to claim 14; wherein the driving gear is disposed in meshing engagement with the teeth of the trigger gear member to displace the teeth of the trigger member in the counterclockwise direction against the bias of the biasing means during rotation of the driving gear in the clockwise direction so that a rotational driving force is not transmitted to the driven gear in the counterclockwise direction.

* * * * *